US006550634B1

(12) United States Patent
Alegre De Miquel et al.

(10) Patent No.: US 6,550,634 B1
(45) Date of Patent: Apr. 22, 2003

(54) SINGLE POP-UP WET WIPE DISPENSING SYSTEM

(75) Inventors: Marita Alegre De Miquel, Liederbach (DE); Northild Busch, Eltville-Rauenthal (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/831,779

(22) PCT Filed: Nov. 19, 1999

(86) PCT No.: PCT/US99/26883

§ 371 (c)(1),
(2), (4) Date: May 14, 2001

(87) PCT Pub. No.: WO00/30956

PCT Pub. Date: Jun. 2, 2000

(30) Foreign Application Priority Data

Nov. 19, 1998 (EP) ..... 89121980

(51) Int. Cl.[7] ..... A47K 10/24
(52) U.S. Cl. ..... 221/48; 221/63
(58) Field of Search ..... 221/47, 48, 50, 221/63; 206/494, 812

(56) References Cited

U.S. PATENT DOCUMENTS 3,780,908 A * 12/1973 Fitzpatrick et al. ..... 221/48
4,138,034 A * 2/1979 McCarthy ..... 221/48
4,863,064 A * 9/1989 Dailey, III ..... 221/48
5,520,308 A 5/1996 Berg, Jr. et al.
5,540,332 A * 7/1996 Kopacz et al. ..... 221/48 X
6,202,845 B1 * 3/2001 Hill ..... 221/48 X
6,250,495 B1 * 6/2001 Bando ..... 221/48

FOREIGN PATENT DOCUMENTS

EP 0 857 453 A1 8/1998
GB 1 449 265 9/1976

* cited by examiner

*Primary Examiner*—James R. Bidwell
(74) *Attorney, Agent, or Firm*—Ian S. Robinson; Ken K. Patel; Steven W. Miller

(57) ABSTRACT

The present invention relates to wet wipes for use in wiping surfaces in the home and in industry, in addition to their use on the human body such as for baby wipes, make-up removal and other skin care applications. The wet wipes are stacked and contained in a dispensing container (20). According to the present invention improved pop up dispensing of the wipes is provided by the combination of the dispensing aperture (29) of the dispensing container (20) having certain dimensions in combination with a wipe stack wherein the wipes are provided such that the average separation force between two adjacent wipes is from 75 g/cm$^2$ to 250 g/cm$^2$.

8 Claims, 3 Drawing Sheets

SINGLE POP-UP WET WIPE DISPENSING SYSTEM

FIELD OF THE INVENTION

The present invention relates to a dispensing system for wet wipes comprising a container and a stack of wet wipes therein which deliver an improved pop-up dispensing of an individual wipe from the wet wipe stack.

BACKGROUND OF THE INVENTION

Wet wipes are typically premoistened, disposable towelettes which may be utilised in a variety of applications both domestic and industrial and perform a variety of functions. Wet wipes are typically used to wipe surfaces both animate and inanimate, and may provide numerous benefits such as cleaning, cleansing, disinfecting, and skin care benefits.

One particular application is the use of wet wipes for wiping parts of the human body particularly when wash water is not available, for example when travelling. Wipes are also commonly used for human cleansing and wiping in general such as anal, perineal and genital cleansing and face and hand cleansing for example as intimate hygiene wipes such as feminine wet wipes. Wet wipes may also be used for application of substances to the body including removing and applying of make-up, skin conditioners and medications. Another application of wipes is during diaper changes and also for the treatment of adult and baby dermatitis partly caused by the use of diapers and incontinence devices. In addition wet wipes are also applicable for wiping and or cleaning other surfaces or for the application of compositions to surfaces, for example kitchen and bathroom surfaces, eyeglasses, shoes and surfaces which require cleaning in industry for example surfaces of machinery or automobiles. Wet wipes also include articles used for the cleaning or grooming of pets.

Wet wipes are commonly provided as a structure of a combination of synthetic and natural fibres, such as polyolefin fibres, viscose fibres and cotton fibres, which are generally moistened with an aqueous composition which contains amongst others surfactants, preservatives, oils and scents. The wipes are then typically packaged in a container in order to facilitate easy transport and storage.

There are two basic types of containers for such wet wipes namely, multi wipe containers and single wipe packages. In typical multi wipe containers, a flexible or rigid moisture impervious container is utilised, the wipes being folded and stacked in such an arrangement therein, so that a single wipe is exposed to and removed by a consumer at one time. These containers have a tub like configuration or a flexible rectangular package, both of which are typically resealable after opening.

A problem with the current wet wipes products is the lack of easy, single wipe dispensation from the wet wipe stack and or the container. This problem is particularly acute in circumstances of use such as when a consumer is holding a baby during a diaper change. Under such conditions the consumer readily needs to be able to pick up and separate one wipe from the container and the stack which is unfolded, using only one hand and without the wipe container being raised from the surface on which it is placed during the removal action. This however is not achieved satisfactorily with current products.

The problem of the lack of satisfactory single wet wipe dispensation from the stack and container is due to a number of reasons. Firstly, wet wipes are typically folded and either placed one on top of the other or interleaved with an adjacent wipe and placed one on top of another to form a stack. The exact location of the leading edge of the upper most wipe of current stacks is however not easily identifiable, either visually or tacitly. This is because the substrate material of the wipe is typically homogeneous and thus the leading edge of the wipe, particularly when folded, cannot be distinguished from the wipe substrate material on which it rests. In addition, the leading edge portion of the wipe also has a tendency to adhere to the underlying wipe substrate material on which it rests. Hence even tactile identification of the edge by running or dragging of the fingers across the wipe surface does not immediately result in the identification of the location of the edge.

Secondly, once the leading edge has been located, it is difficult for the consumer to grasp hold of sufficient substrate material and maintain grasp thereof, in order to separate a single wipe from the stack upon which it rests. The consumer often is only able to grasp a small portion of the leading edge such that a tight grip thereof is not established and hence the wipe easily slips from the fingers of the consumer.

These problems associated with wet wipe dispensation have been recognised in the art. For example U.S. Pat. No. 5,540,332 addresses dispensability of wet wipes and a method of producing these wipes. The improved dispensability is achieved by providing at least a portion of one of the end edges of the wipe with a repeating non-linear pattern such as a sine wave configuration. However, the problem of single wet wipe dispensation is neither addressed or overcome by the use of a non linear leading edge.

Another proposed solution to the dispensing problem is described in U.S. Pat. No. 4,778,048, which discloses a product comprising a stack of wet wipes tilted on edge within a container for improved access, dispensing and equal liquid distribution. In a preferred embodiment, the edge of each wipe has a Gurley Stiffness greater than the stiffness of the main body of the wipe. However, the provision of such a stiff edge is in itself an undesirable characteristics of a wet wipe. Wet wipes, particularly those intended for use on sensitive areas of the skin such as baby wipes require a certain degree of softness. The edge of the wipe which is stiffened is no longer suitable for use as is indeed recognised in the patent itself, and hence the wipes have a reduced substrate surface suitable for use. Also care needs to be taken to reduce or avoid contact of this edge portion with the skin as it may cause irritation. Moreover, the stiffness of the edge again does not solve the problem of single wipe dispensation. In addition, the provision of such a non linear edge on a nonwoven substrate using current manufacturing techniques would also result in the fraying of the edges of the substrate which is also highly undesirable.

Another key contributory factor to the problem of single wet wipe dispensation from the wet wipe stack is the tendency of the wipe substrate material to adhere to itself. This is in particular, due to the compression of the wipe stacks during manufacture and storage, the actual weight of the stack of wipes themselves, and the existence of attractive forces in-between the substrate material and the composition lotion of the wipes. As a result, when the wipes are folded to form a stack, the substrate material tends to adhere to itself and the substrate material of adjacent wipes. Consequently, once the consumer has raised the wipe from the stack or pulls the wipe through the dispensing orifice, the wipe tends to maintain its folded configuration. Moreover, the wipe typically remains at least partially adhered to the adjacent wipe on which it was resting. Hence, in addition during the action of wipe removal from the stack, the adjacent wipe is also at least partially separated from the stack. As a result the consumer is required not only to unfold the wipe before commencing with the desired application of the wipe but also, to separated it from the adjacent wipe in the stack and returned this wipe to the stack in the container. This is obviously particularly inconvenient to consumers utilising baby wipes during diaper changes.

The problem of substrate wipe adhesion has been recognised in the prior art. Attempts at resolving this problem have typically resided in the provision of certain interleaving configurations for the wipes as for example described in JP 08 089 439.

However, many of the proposed interleaving configurations have associated problems therewith. In particular, when as a result of interleaving the degree of overlap of substrate material between adjacent wipes is large, then the problem of substrate adhesion is merely exacerbated such that the wipes are effectively always released in pairs. On the other hand, if the overlap between adjacent wipes is minimised such that single wipe dispensation is guaranteed, there is no recognisable separation of the adjacent wipe from the stack and the problem of leading edge identification reappears.

Another problem with the current stacking of wet wipes is that a large amount of the substrate material of the adjacent wipe is still exposed through the orifice after wipe dispensation is complete, particularly for folding configurations having a large overlap of substrate material between adjacent wipes. As a result, the wipe becomes dry and unsuitable for use and has to be discarded. EP 747 313 proposes a means to address this problem and discloses a multiple folded paper, such as wetted tissue paper, for continuous disposal through a container orifice. In this manner a maximum of a quarter of the length of the adjacent wipe is exposed through the dispensing orifice. However, such paper tissue products cannot be utilised for all wet wipe applications, such as baby wipes, as the wetted tissue paper is not satisfactory in terms of softness or strength. In particular, such wetted tissues suffer from a tendency to tear during use and hence are not suitable for use as wet wipes.

Alternatively, it has also been proposed to provide specifically designed dispensing containers, so called pop-up dispensers, to improve dispensing. These dispensers are comprised of a container having an upper panel having an orifice. The pop-up dispensers function on the principle of providing a dispensing orifice which is relatively small, and which is sized and configured so that in combination with a stack of wipes having a particular folding configuration so that the upper portion of the adjacent wipe is held within the dispensing. These containers are thus designed such that during the removal action of the upper most wipe from the container through the aperture, the adjacent wipe is elevated from the stack such that it partially protrudes through the orifice once the upper most wipe has been removed. In this manner the uppermost wipe is positioned for easy grasp by the consumer. These type of pop-up dispensers allow the wipes to be provided either on a continuous roll with perforations therein or as separately folded wipes as for example described in U.S. Pat. No. 5,560,514.

Unfortunately, the provision of dispensers with typically very small dispensing apertures is not considered desirable by the consumer. In particular such small orifices prevent the consumer from being able to see and examine the inner contents of the container and estimate the number of wipes remaining therein. In addition if pop up failure occurs and the wipe adjacent to the dispensed wipe is not elevated from the stack, due to the small dispensing orifice size the consumer is unable to easily feed the wipe through the dispensing orifice and is required to dismantle the dispenser itself. Likewise a similar problem is encountered if the consumer inadvertently removes too many wipes than required from the dispenser and attempts to push them back into the dispenser.

It is therefore on abject of the present invention to provide a wet wipe dispensing system which facilitates single wipe separation from the stack and container, such that the wipe is unfolded and ready for use without any of the aforementioned problems.

SUMMARY OF THE INVENTION

The present invention hence relates to a wet wipe for wiping parts of the human body such as baby wipes and other surfaces. In particular, the present invention relates to a pop up wet wipe dispensing system so as to facilitate ease of dispensation and separation of a single wipe from the stack of wet wipes within a dispensing container throughout the diminishing height of the stack. The dispensing container comprises a container body, said container body comprising a lower portion and an upper portion, the upper portion comprising a dispensing aperture having a cross sectional area of from 14 $cm^2$ to 65 $cm^2$. The wipes have an average separation force between two wipes as defined by the test method herein of from 75 $g/cm^2$ to 250 $g/cm^2$.

DETAILED DESCRIPTION OF THE INVENTION

Figure 1:
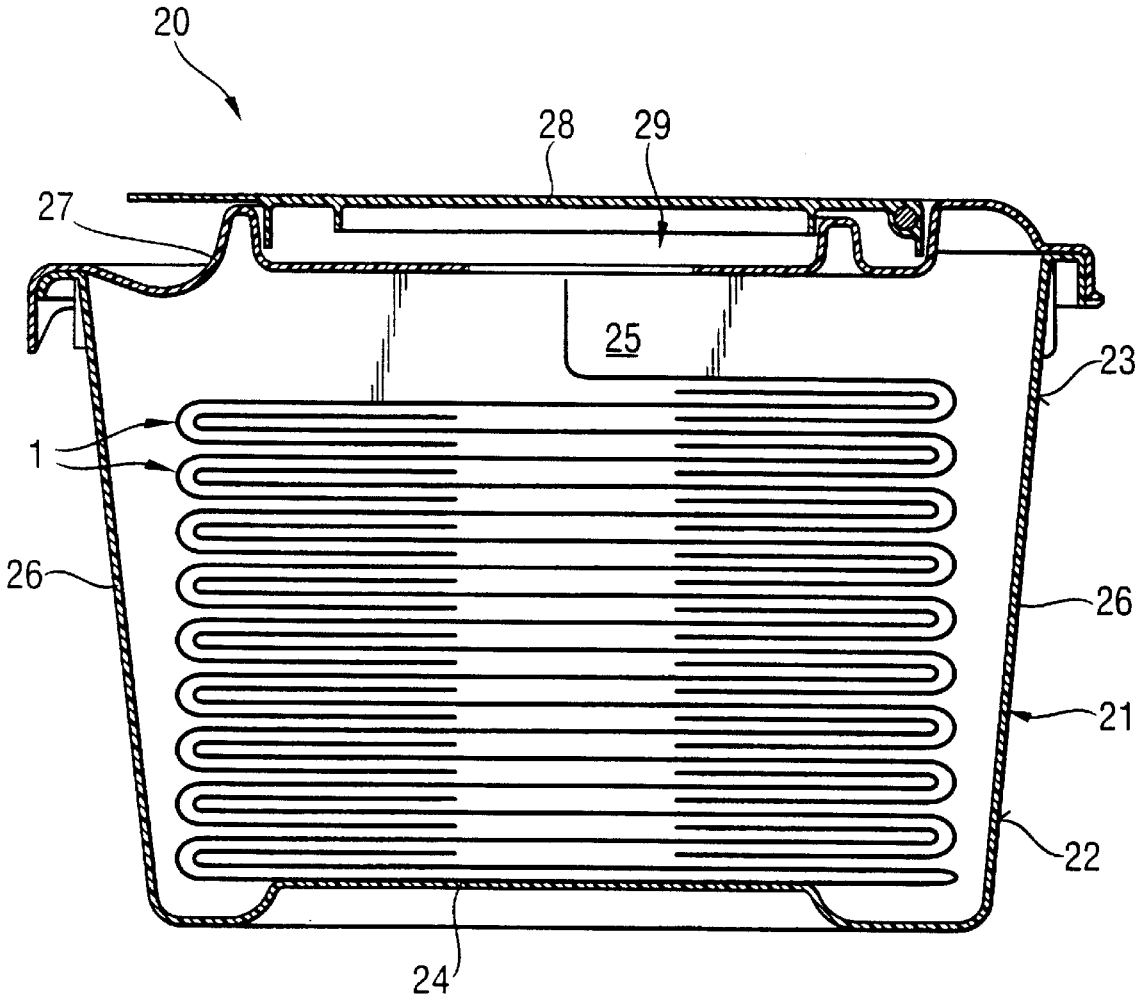
FIG. 1: Is a cross sectional schematic illustration of a stack of wet wipes in a dispensing container 20.

According to the present invention the wet wipe comprises a substrate which is coated or impregnated with a liquid composition. The substrate may be woven or nonwoven, foam, sponge, battings, balls, puffs or films, most preferably a nonwoven and may be composed or natural or synthetic fibres or mixtures thereof. Preferably, the fibre compositions are a mixed of hydrophilic fibre material such as viscose, cotton, or flax and a hydrophobic fibre material such as polyethylene tetraphthalate (PET) or polypropylene (PP) in a ratio of 20%–80% hydrophilic and 80%–20% hydrophobic material by weight. Two particularly preferred compositions are 50% viscose/50%PP and 50% viscose/50% PET. The substrate preferably has a basis weight of at least 20 $gm^{-2}$ and preferably less than 150$gm^{-2}$, and most preferably the base weight is in the range of 20 $gm^{-2}$ to 70 $gm^{-2}$, more preferably from 50 $gm^{-2}$ to 65 $gm^{-2}$. The substrate may have any calliper. Typically, when the substrate is made by a hydroentangling process, the average substrate calliper is less than 0.8 mm. More preferably the average calliper of the substrate is from 0.1 mm to 0.4 mm. The substrate calliper is measured according to standard EDANA non woven industry methodology, reference method #30.4-89. The bulk density of the substrate is preferably not more than 1.0 g/cm$^3$, preferably not more than 0.9 g/cm$^3$, most preferably not more than 0.7 g/cm$^3$.

In addition to the fibres used to make the substrates, the substrate can have other components or materials added thereto as known in the art. The types of additives desirable will be dependent upon the particular end use of the substrate contemplated. For example, in wet wipe products such as moist toilet paper, paper towels, facial tissues, baby wipes and other similar air laid products, high wet strength is a desirable attribute. Thus, it is often desirable particularly for cellulose based substrates to add chemical substances known in the art as wet strength resins. A general dissertation on the types of wet strength resins utilised in the paper art can be found in TAPPI monograph series No. 29, Wet Strength in Paper and Paperboard, Technical Association of the Pulp and Paper Industry (New York, 1965). In addition to wet strength additives, it can also be desirable to include certain dry strength and lint control additives known in the art such as starch binders. Furthermore, the substrate may also comprise agents to improve the optical characteristics of the substrate material such as opacifying agents, for example titanium dioxide.

According to the present invention the substrate may be produced by any methods known in the art. For example nonwoven substrates can be formed by dry forming techniques such as air-laying or wet laying such as on a paper making machine. Other nonwoven manufacturing techniques such as melt blown, spun bonded, needle punched and spun laced methods may also be used. A preferred method is hydroentangling.

The substrate may be comprised of one or a multiplicity of layer, preferably two or three layers of material. These layers may be identical in terms of composition and or manufacturing techniques or a combination of any of the materials described herein above. Preferably one of the layers may be a scrim reinforcing layer, as described for example in U.S. patent application Ser. No. 09/133294.

According to the present invention the substrate of the wet wipe has a central panel and two opposing end edge panels, a leading edge panel and a trailing edge panel. Each of said panels has a first upper surface and a second lower surface.

Each folded wipe 1 extends lengthwise in the machine direction from a first, leading end edge 2, to a second, trailing end edge 3. The folded webs also have side edges 4 and 5 which extend lengthwise from the first leading end edge 2 to the second trailing end edge 3. Each folded wipe 1 can include a first panel fold 6 which is generally parallel to the leading edge 2, and which is generally perpendicular to the side edges 4, 5. The first panel fold 6 is spaced lengthwise from the leading edge 2 to provide a leading edge panel 9 extending between the first panel fold 6 and the leading edge 2. As used herein a panel is a portion of the wipe extending between two folds, or between a fold and an edge end.

The folded wipe can also include a second panel fold 7, and a central panel 8, and a trailing edge panel 10. The second panel fold 7 is generally parallel to, and spaced lengthwise from, the first panel fold 6. The central panel 8 is joined to the leading edge panel 9, at the first panel fold 6, and extends between the first panel fold 6 and the second panel fold 7.

Figure 2:
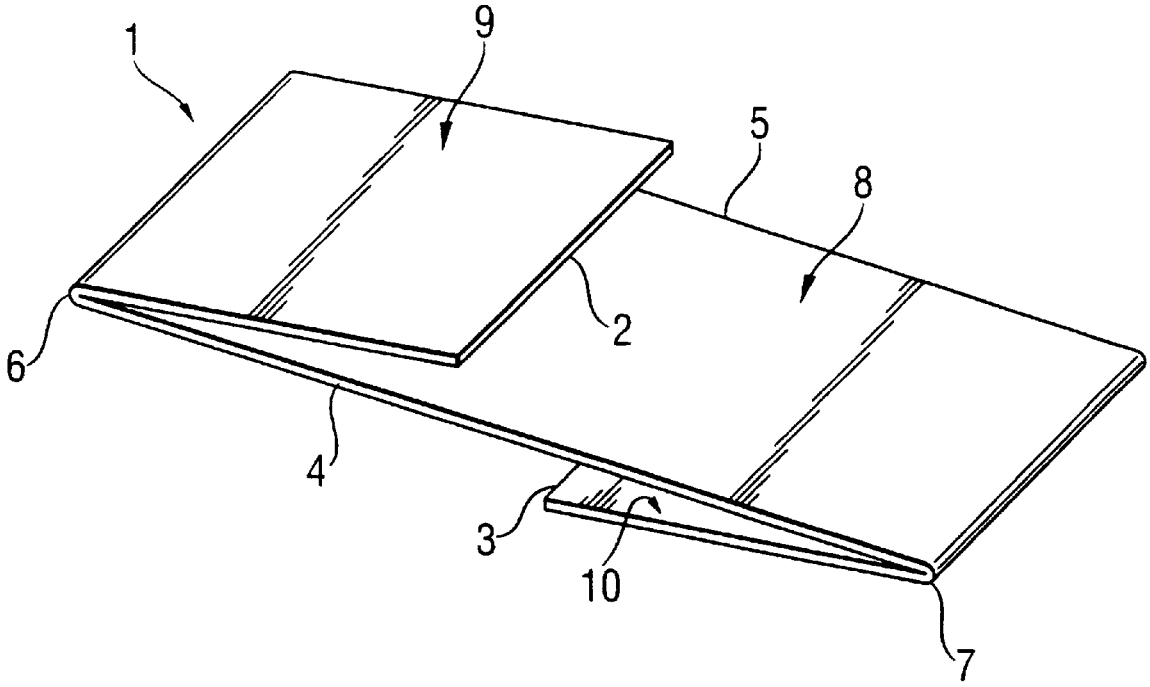
FIG. 2: Is a cross sectional illustration showing a wipe 1 having a leading edge panel 2, a central panel 4 and a trailing edge panel 3 and folded in a Z fold configuration.
Figure 3A:
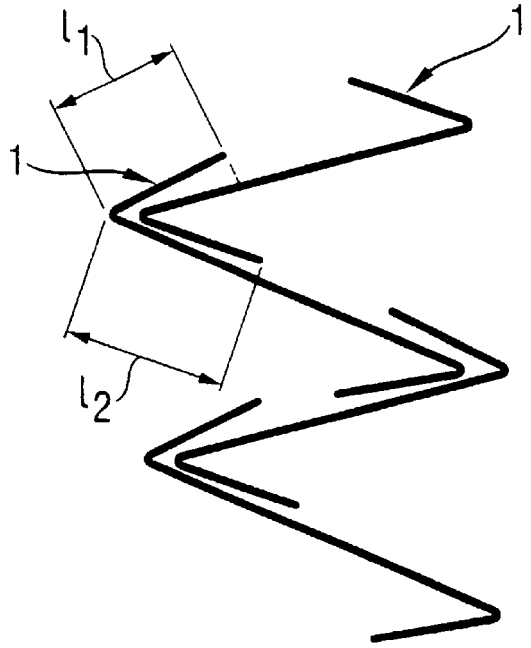
FIGS. 3*a* & 3*b*: Are cross sectional illustrations of preferred folding and interleaving configurations for wet wipes according to the present invention.
Figure 3B:
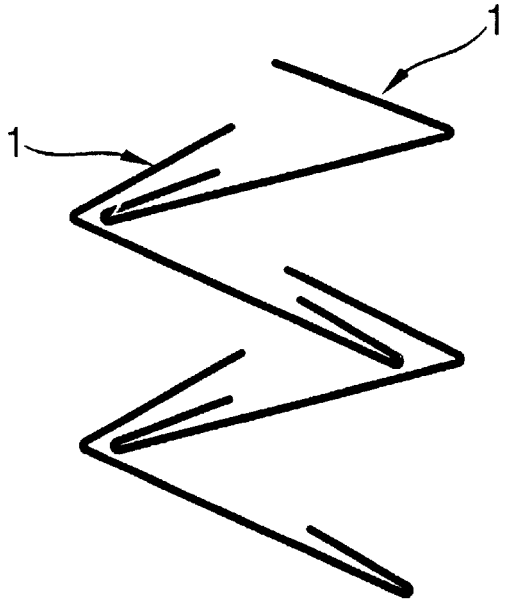

The trailing edge panel 10 is joined to the central panel 8 at the second panel fold 7. The trailing edge panel 10 extends between the second panel fold 7 and the trailing end edge 3. The wipe is folded at the first and second panel folds 6 and 7 to provide the leading edge panel, central panel, and trailing edge panels 9, 8 and 10, in a Z-fold configuration, as best seen in FIGS. 2 and 3. In the Z-fold configuration, panel 9 is adjacent to and overlies a portion of panel 8, and panel 10 is adjacent to and underlies a portion of panel 8. However other folding configurations such as C folds or J folds are equally applicable. Furthermore in addition to the panels described herein above, the wipe may have additional panels. In particular, the leading edge panel and or the trailing edge panel may also be provided with an additional fold so as to provide a leading edge panel lip or a trailing edge panel lip. Such a lip is formed by providing the leading edge panel or the trailing edge panel with a panel lip fold which is adjacent to and spaced from the leading or trailing edge of the folded substrate to provide a lip extending between the panel lip fold and the end edge. The panel lip fold may be folded onto the lower surface of the leading edge panel such that the leading end edge is below the leading edge end panel. This configuration is particularly beneficial in facilitating grasping of the edge. Alternatively, the leading edge panel may be folded such that the leading end edge rests on the upper surface of the leading edge panel. The lip may also be positioned on the upper or lower surface of the trailing edge panel. The lip typically extends from the leading or trailing edge form between 4 cm to 0.1 cm, preferably from 2 cm to 0.25 cm to the leading edge panel lip fold or the trailing edge panel lip fold.

Referring to FIGS. 2 and 3, the folded wipes 1 are interfolded between adjacent folded wipes 1. For instance, a panel such as panel 10 on one folded wipe 1, could be interleaved between panels 9 and 8 of an adjacent, underlying folded wipe. According to the present invention the wipes are stacked in groups of discrete folded wipes. Multiple stacks of the discrete folded wipe can then be combined one on top of the other to provide a stack as shown in FIG. 2. However, the number of wipes in a discrete stack and the combination of stacks can be varied as required and depending on the container with which they are to be combined. A particularly preferred folding configuration of the wipes according to the present invention is described in European Patent Application number 97108388.6, PCT/US98/10603 and EP 747 313 and incorporated herein by reference.

According to the present invention, the overall dimensions of the substrate material is dependent on the intended application of the wipe and can be selected accordingly. In one non limiting, illustrative example wherein the wipe may be utilised as a baby wipe, each folded wipe 1 can have an unfolded length of from 10 cm to 30 cm as measured lengthwise from the leading end edge 2 to the trailing end edge 3. For each folded wipe 1, the spacing between the first panel fold 6 and the second panel fold 7 can be from 2 cm to 7 cm, while the lengths of the leading edge panel 9 and trailing edge panel 10 can be from 2 cm to 7 cm. In a preferred embodiment the spacing between the first panel fold 6 and the leading end edge 2 is more preferably from 3 cm to 6 cm, and even more preferably between about 3 cm and 5 cm. The spacing between the first panel fold 6 and the second panel fold is more preferably from 3 cm to 12 cm, and even more preferably between about 10 cm and 12 cm. The spacing between the second panel fold 7 and the trailing edge is more preferably from 3 cm to 6 cm, and even more preferably between about 3 cm and 5 cm.

According to the present invention the improved pop up dispensing of the wipes is provided by the combination of the above described dispensing aperture of the dispensing container as described herein below with wipes stacked such that the average separation force between two adjacent wipes is from 75 g/cm$^2$ to 250 g/cm$^2$, preferably from 100 g/cm$^2$ to 200 g/cm$^2$ more preferably from 125 g/cm$^2$ to 175 g/cm$^2$ as defined in the test method hereinafter. Whilst not being bound by theory it is believed that the upper separation force limit is required in order to prevent chaining of the wipes whilst the lower limit ensures substrate stability and prevents fall back of the wipes.

According to the present invention any means by which the separation force between adjacent wipes can be adapted to meet the requirements above can be utilised and thus includes both physical or mechanical means, chemical means and combinations thereof. Preferably these means should be selected so as to minimise their impact on the characteristics of the substrate material per se so that the wipe maintains its desirable characteristics such as softness, absorbency and wet strength and may be provided to the wet wipe panels at any stage of the manufacturing process.

Suitable physical/mechanical means for providing the surface of the wet wipe with the separation force include for example embossing, crimping, thermal bonding, ultra-sonic bonding and printing, for example water jet printing. Such methods are well known to the skilled person in the art. One preferred method is provide the surface of the wipe substrate with a surface topography of peaks and valley, by the use of scrim partially bonded to another layer as described in U.S. Ser. No. 09/133,294 incorporated by reference.

Alternatively the fibres of which the substrate material is composed of can b selected so as to be hydrophobic and or provide a low friction substrate by for example the reduction in the presence of long or protruding fibres from the surface of the substrate. Similarly the manufacturing methods employed for the substrate can also be selected so as to provide the desired separation force. For example airlaying techniques are considered to raise the separation force whilst wet laying reduces it.

Suitable chemical means of adapting the separation force between wipes include lubricants, silicone release coating from Dow Corning of Midland, Mich. available as Syl-Off 7677 to which a crosslinker available as Syl-Off 7048 is added in proportions by weight of 100 parts to 10 parts, respectively. Another suitable treatment is a coating of a UV curable silicone comprising a blend of two silicones commercially available from General Electric Company, Silicone Products Division, of Waterford, N.Y., under the designations UV 9300 and UV 9380C-D1, in proportions by weight of 100 parts to 2.5 parts, respectively. When such a silicone blend is utilised on the substrate coating application levels of at least 0.25 g, preferably 0.5 to 8.0 grams silicone per square meter of surface area have performed satisfactorily, although other coating levels may prove suitable for certain applications depending upon for example the nature of the substrate and the characteristics of the lotion. Other suitable treatment materials include, but are not limited to, fluorinated materials such as fluoropolymers (e.g., polytetrafluoroethylene (PTFE), commercially available under the trade name TEFLON") and chlorofluoropolymers. Other materials which may prove suitable include hydrocarbons such as petrolatum, latexes, paraffins, quaternary ammonium compounds, oils, essences and the like, although silicone materials preferably long chained and or branched silicones are presently preferred for use in the wet wipes for their biocompatibility properties. Preferred silicones include dimethicone copolyols. Others include any of the commercial water repellents listed in McCutcheon's Volume 2: Functional Materials 1995, McCutcheon's Division, The Manufacturing Confectioner Publishing Co. (the disclosure of which is incorporated by reference herein), of which GrapHsize, available from Akzo Nobel Chemicals Inc., and Norgard 10-T, available from Norman, Fox & Co., are preferred. Other suitable means include coating with photosensitive resins. According to the present invention such chemicals may be applied to the surface of the panel by any means such as coating, spraying, extruding, printing, or impregnation of the surface per se or of the substrate fibres. These chemicals maybe added to the substrate as a component of the lotion or independently.

According to the present invention the wet wipes are stacked and then stored in a rigid dispensing container 20. The container 20 comprises a container body 21 comprising a lower portion 22 and an upper portion 23. The container 20 may be provided in any shape such as a cuboid, rectangular solid, cylinder and the like depending on the end use intended and the nature and shape of the wet wipes themselves. Preferably the container 20 is a rectangular solid and is typically made of a body portion having a base wall 24, end walls 25, side walls 26 and optionally a top wall 27, which are integrally molded. The container is preferably molded form any suitable plastic material by thermomolding or injection molding techniques for example. Suitable plastics include polypropylene, polyethylene, polystyrene, acrylonitryl butadiene styrene, polyester, polyvinyl chloride, polycarbonate and high density polyethylene. Preferably the container 20 is formed from polypropylene. Typically these container may have dimensions of about 30 cm by 20 cm by 12 cm, preferably 25 cm by 15 cm by 10 cm.

In a preferred embodiment the container of the present invention is provided with a lid 28. The lid 28 is typically mounted onto the container body 21 at the upper portion 23 and may be affixed thereto by means of threads, snap fitting, interengaging ribs, frictional engagement and the like. Alternatively the lid 28 may be attached to the container body 21 by a hinge mechanism. The wipes are either placed directly in the container 20 or alternatively, the wipes can be stacked and then packaged in a moisture impervious wrapper, such as a foil or polymeric film wrapper, to provide a refill package for use in refilling the container.

The upper portion 23 of the container body 21 which is either integral with the container body 21 and provided with a top wall 27 or is provided by the lid 28 attached to the container body 21 is provided with a dispensing aperture 29. According to the present invention the dispensing aperture 29 is selected so as to provide an open surface area of from 14 cm$^2$ to 65 cm$^2$, preferably from 15 cm$^2$ to 50 cm$^2$, more preferably from 20 cm$^2$ to 35 cm$^2$. The aperture may have any shape such as circular, rectangular, oval and the like or S shape or may also have wings as described for example in WO98/199946. Most preferably the aperture has a rectangular or oval shape. Preferably the aperture should be provided such that it is rigid and does not alter its shape significantly during use and there should be no sharp edges or corners upon which the wipes or the consumers fingers could become snared. The upper portion of the container body may also be provided with a recess such that any excess wipe substrate protruding from the aperture can be placed in-between the lid and the body portion.

According to the present invention, the substrate material is typically impregnated or coated with a liquid composition. An advantage of the present invention is that the stacking configuration allows a variety of composition to be used with the substrate material without significant impact on the dispensing mechanism. This is not only useful in allowing the nature of the composition to be varied, but also allows the loading of the composition throughout the stack to be varied in order to combat the composition settling at the base of the stack. According to the present invention the term liquid composition refers to any composition which is in a liquid form when the wipe is in contact with the surface. Typically, the composition may be aqueous, alcohol based or an emulsion, either a water-in-oil or an oil-in-water or a multiple emulsion, preferably the emulsion is a oil-in-water emulsion. The emulsion may also comprise a lipid phase which can be broken by the application of minimal pressure for example by wiping the skin. Typically, the composition will comprise from 2% to 50% by weight of said composition of actives and from 50% to 98% water, preferably de-ionised or distilled. Of the active component, preferably 2% to 20% are present in the oil phase and the remainder are present in the aqueous phase.

According to the present invention the wet wipes are provided with an emulsion composition comprising a oil phase in the range of 1% to 20%, preferably 2% to 10%, by weight of the composition. Advantageously, the oil based phase is derived from natural resources such as from vegetable or animal oils or may be synthetic or any mixtures thereof. Suitable vegetable and animal oils for use herein include waxes such as beeswax, lanolin, candelilla, and oils such as glycerine esters and glycerine ethers, fatty acid alcohols, fatty acid esters and fatty acid ethers such as caprylic and capric triglycerides and octylpalmitate. Suitable mineral oils include petroleum based oils such as paraffin and petroleum jelly. Synthetic oils for use herein include ethylenic polymers for example polyethylene wax or silicone based oils. Suitable silicon oils include polydimethylsiloxanes, volatile cyclo- methicones, dimethiconols, siloxysilicates and amino- and phenyl derivatives of siloxanes and mixtures thereof. Examples include dimethicone (Dow Corning 200 Fluids), cyclomethicone and dimethiconol (Dow Corning 1401 Fluid), cetyl dimethicone (Dow Corning 2502 Fluid), dimethicone and trimethylsiloxysilicate (Dow Corning 593 Fluid), cyclomethicone (Dow Corning 244, 245, 344 or 345 Fluid), phenyl trimethicone (Dow Corning 556 Fluid), or combinations thereof.

The oil-in-water emulsions typically require emulsifying agents. The emulsifying agents which may be used in the present invention are preferably capable of primary emulsification of oil-in-water emulsions. The emulsifying agent is present in the range of 0.02% to 5.0%, preferably 0.02% to 3.0%, by weight of the composition.

In a preferred embodiment the emulsifying agent is a polymeric type of emulsifying agent such as a copolymer of C10–C30 alkyl acrylates and one or more monomers of acrylic acid, methylacrylic acid or one of their simple esters cross linked with an allyl ether of sucrose or an allyl ether of pentaerythritol. The emulsifying agents which are thus useful in the present invention include Ceteareth-12, Ceteareth-20 or Pemulen TR1 and TR2 which are available from B.F. Goodrich company of the USA. However, other known emulsifying agents such as ethoxylated fatty alcohols, glycerine esters of fatty acids, soaps, sugar derived agents are also suitable for use herein. Other useful emulsifying agents include those disclosed in detail in EP-A-328 355.

According to the present invention the composition may comprise a stability agent or preservative. Stability agents suitable for use herein include phenoxyethanol preferably present in the range of from 0.1 to 1.0%, sodium benzoate, potassium sorbate, methylparaben, propylparaben, ethylparaben, butylparaben, sodium benzoate, potassium sorbate, benzalkonium chloride, and disodium salt ethylenediamine tetraacetic acid (hereinafter referred to as EDTA) or other EDTA salts (sequestrenes). Sequestrene is a series of complexing agents and metal complexes general of ethylenediamine-tetraacetic acid and salts. The total quantity of stability agents should be in the range of 0.1% to 4.0% by weight of the composition.

The composition of the present invention may further comprise from 0.02% to 5.0% by weight of said composition of an emollient or moisturiser. Preferably the emollient is water soluble and includes polyhydric alcohols, such as propylene glycol, glycerin, and also water soluble lanolin derivatives.

Further optional ingredients which may be used in the present invention include, anti fungal agents, antibacterial agents, skin protectants, oil soluble cleansing agents, water soluble surfactants or detergents, preferably nonionic or amphoteric, pH adjusters, perfumes, fragrances and the like.

In order for the emulsion to provide the wet wipe with good cleaning performance the delivered viscosity should be less than 500 mPas, preferably in the range of 300 to more than 100 mPas and most preferably in the range of 180 to 120 mPas.

In preparing wet wipe products according to the present invention, the composition is applied to at least one surface of the substrate material. The composition can be applied at any time during the manufacture of the wet wipe. Preferably the composition can be applied to the substrate after the substrate has been dried. Any variety of application methods that evenly distribute lubricious materials having a molten or liquid consistency can be used. Suitable methods include spraying, printing, (e.g. flexographic printing), coating (e.g. gravure coating or flood coating) extrusion whereby the composition is forced through tubes in contact with the substrate whilst the substrate passes across the tube or combinations of these application techniques. For example spraying the composition on a rotating surface such as calender roll that then transfers the composition to the surface of the substrate. The composition can be applied either to one surface of the substrate or both surfaces, preferably both surfaces. The preferred application method is extrusion coating.

The composition can also be applied non uniformly to the surfaces of the substrate. By non uniform it is meant that for example the amount, pattern of distribution of the composition can vary over the surface of the substrate. For example some of the surface of the substrate can have greater or lesser amounts of composition, including portions of the surface that do not have any composition on it. The composition is typically applied in an amount of from about 0.5 g to 10 per gram of substrate, preferably from 1.0 g to 5 g per gram of substrate, most preferably from 2 g to 4 g per gram of dry substrate.

Preferably, the composition can be applied to the substrate at any point after it has been dried. For example the composition can be applied to the substrate prior to calendering or after calendering and prior to being wound up onto a parent roll. Typically, the application will be carried out on a substrate unwound from a roll having a width equal to a substantial number of wipes it is intended to produce. The substrate with the composition applied thereto is then subsequently severed to produce individual wipes.

Test Method

Separation Force Test Method

This method measures the force which is needed to separate wet wipes. It imitates the machine converting of wipes, however, variables such as differences in folding or packaging design are eliminated. The test results are dependent upon the nature of the substrate and lotion but also the folding design.

Preparing the Sample

1. A stack of 20 dry folded wipes are weighed, and the weight to be achieved with a given lotion load is calculated. The wipes are put into a plastic box and soaked with approx. 125 ml of lotion. Half of the lotion is poured onto the stack, then it is turned over and the remaining lotion is added. The stack is then squeezed by hand in the box to make the lotion soak the whole sample.
2. The stack is taken out from the plastic box and put onto a plastic block which is slightly larger than the stack. With another plastic block the excess lotion is squeezed out until the necessary weight for a given lotion load (calculated in step one) is reached.
3. The wipes are then one by one unfolded and on a plastic foil put on top of each other with an overlap corresponding to the length of the overlap of the folding configuration (as illustrated on FIG. 3*a* as $I_1$ and $I_2$). The upper surface of the wipe stack is then covered by plastic foil.
4. The stack is put on the floor/hard surface. A piece of non-deformable plastic, at least as big as the overlap area, is put on top of it, and the stack is compressed with 20 kg for 15 sec. As weight, a canister with water to give a total weight of 20 kg can be used. Care should be taken to lower the canister very slowly to ensure that the initial pressure exerted by the canister does not exceed 20 kg.

Measuring the Separation Force

1. The samples should be measured immediately after converting. However, preparing two samples at a time, then compressing both, then measuring both, is acceptable.
2. To measure the separation force, the upper plastic foil is opened. Often, the first wipe remains stuck to it or at least gets looser. In any case, the first wipe is removed and measuring starts with the pair of wipe 2 and 3.
3. Wipe 3 is carefully separated from the stack and therefore wipe 2 too, sticking on top of it. The wipes are clamped into the tensile strength measuring machine. It pulls them apart and gives the needed force in grams.
4. The whole stack is measured in pairs. The last wipe is discarded, as well, so each sample of originally 20 wipes will give 9 data points.
5. Standard deviation is usually in a range of approx. 5%.

What is claimed is:

1. A dispensing container, said container comprising a plurality of wet wipes, said container comprising a container body, said container body comprising a lower portion and an upper portion, said upper portion comprising a dispensing aperture, said aperture having across sectional area of from 14 $cm^2$ to 65 $cm^2$ and said wipes having an average separation force between two wipes as defined by the test method herein of from 75 $g/cm^2$ to 250 $g/cm^2$ and each of said wipes is folded in a Z fold configuration and interleaved with at least one adjacent wipe.

2. A dispensing container according to claim 1, wherein said separation force is from 100 $g/cm^2$ to 200 $g/cm^2$.

3. A dispensing container according to claim 1, wherein said separation force is from 125 $g/cm^2$ to 175 $g/cm^2$.

4. A dispensing container according to claim 1, wherein said dispensing aperture has a cross sectional area of from 15 $cm^2$ to 50 $cm^2$.

5. A dispensing container according to claim 1, wherein said aperture has a rectangular or oval shape.

6. A dispenser according to claim 1, wherein each of said wipes comprise a substrate and a liquid composition, wherein said liquid composition comprises a silicone oil.

7. A dispenser according to claim 1 wherein each wipe comprises a substrate comprising hydrophobic fibres selected from polyethylene terephthlate, polypropylene or mixtures thereof.

8. A dispenser according to claim 1, wherein each of said wipes comprises a substrate, wherein said substrate is a hydroentangled nonwoven.

* * * * *

UNITED STATES PATENT AND TRADEMARK OFFICE

CERTIFICATE OF CORRECTION

PATENT NO. : 6,550,634 B1
DATED : April 22, 2003
INVENTOR(S) : Alegre De Miquel et al.

It is certified that error appears in the above-identified patent and that said Letters Patent is hereby corrected as shown below:

Title page,
Item [30], Foreign Application Priority Data, please delete "89121980" and insert therefor
-- 98121980.1 --.

Column 10,
Line 48, please delete "10 per" and insert therefor -- 10 g per --.

Column 11,
Line 18, please delete "$I_1$ and $I_2$" and insert therefor -- $1_1$ and $1_2$ --.

Column 12,
Line 12, please delete "across" and insert therefor -- a cross --.

Signed and Sealed this

Thirteenth Day of July, 2004

JON W. DUDAS
*Acting Director of the United States Patent and Trademark Office*